US008510000B2

(12) United States Patent
Kawasaki et al.

(10) Patent No.: US 8,510,000 B2
(45) Date of Patent: Aug. 13, 2013

(54) HYBRID CONSTRUCTION MACHINE

(75) Inventors: Haruhiko Kawasaki, Minato-ku (JP); Masahiro Egawa, Minato-ku (JP)

(73) Assignee: Kayaba Industry Co., Ltd., Minato-ku, Tokyo (JP)

( * ) Notice: Subject to any disclaimer, the term of this patent is extended or adjusted under 35 U.S.C. 154(b) by 217 days.

(21) Appl. No.: 12/991,074

(22) PCT Filed: Mar. 26, 2009

(86) PCT No.: PCT/JP2009/056039

§ 371 (c)(1),
(2), (4) Date: Nov. 4, 2010

(87) PCT Pub. No.: WO2009/119705

PCT Pub. Date: Oct. 1, 2009

(65) Prior Publication Data

US 2011/0071738 A1 Mar. 24, 2011

(30) Foreign Application Priority Data

Mar. 26, 2008 (JP) ..... 2008-081551
May 23, 2008 (JP) ..... 2008-135229

(51) Int. Cl.

| | |
|---|---|
| ***G06F 7/70*** | (2006.01) |
| ***B60L 9/00*** | (2006.01) |
| ***B60K 6/20*** | (2007.10) |
| ***B60W 10/00*** | (2006.01) |
| ***B60W 20/00*** | (2006.01) |

(52) U.S. Cl.
USPC ..... 701/50; 701/22; 180/65.21; 180/65.265; 180/275

(58) Field of Classification Search
USPC ..... 701/50, 22; 180/65.21
See application file for complete search history.

(56) References Cited

U.S. PATENT DOCUMENTS

| | | | | | |
|---|---|---|---|---|---|
| 4,774,921 | A * | 10/1988 | Sakaguchi et al. | ..... | 123/385 |
| RE36,151 | E * | 3/1999 | Ishino et al. | ..... | 701/50 |
| 5,995,895 | A * | 11/1999 | Watt et al. | ..... | 701/50 |
| 6,050,091 | A * | 4/2000 | Maruta | ..... | 60/436 |
| 6,151,894 | A * | 11/2000 | Endo et al. | ..... | 60/414 |
| 6,694,240 | B1 * | 2/2004 | Swick et al. | ..... | 701/50 |
| 2003/0097837 | A1 * | 5/2003 | Hiraki et al. | ..... | 60/486 |
| 2005/0103006 | A1 * | 5/2005 | Yoshino | ..... | 60/413 |
| 2005/0246082 | A1 * | 11/2005 | Miki et al. | ..... | 701/50 |
| 2006/0090461 | A1 * | 5/2006 | Yoshino | ..... | 60/468 |
| 2006/0090462 | A1 * | 5/2006 | Yoshino | ..... | 60/468 |
| 2007/0187180 | A1 * | 8/2007 | Kagoshima et al. | ..... | 182/232 |
| 2011/0071738 | A1 * | 3/2011 | Kawasaki et al. | ..... | 701/50 |

* cited by examiner

*Primary Examiner* — Thomas Black
*Assistant Examiner* — Tyler Paige
(74) *Attorney, Agent, or Firm* — Beverly W. Lubit; Greenberg Traurig LLP

(57) ABSTRACT

Effective use of energy is provided by recovering energy produced during braking in operation of a rotation motor RM alone for electric generation. A control unit C has functions: of operating a passage-resistance control unit (51) to reduce the passage resistance by a pressure relief valve 50 when determining based on a detection signal from a neutral-condition detecting unit (6, 8, 9, 11 and 16, 18, 19, 21) that all the operated valves 1-5, 12-15 in the circuit system are in the neutral position and a pressure signal from a brake-pressure-detection processor sensor 49 reaches a preset pressure; of causing a tilt-angle control unit 36 to control the tilt angle of a hydraulic motor HM; and of relatively controlling the passage resistance maintained by controlling the passage resistance control unit and the tilt angle of the hydraulic motor to maintain a brake pressure of the rotation motor.

18 Claims, 4 Drawing Sheets

HYBRID CONSTRUCTION MACHINE

BACKGROUND OF THE INVENTION

1. Field of the Invention

This invention relates to a controller for controlling a drive source of a construction machine such as, for example, a power shovel and the like, and also controlling energy recovery.

2. Description of the Related Art

Techniques of generating electric power by the use of a return flow from an actuator or the like to rotate a generator have been widely known. One of them recovers energy produced by a rotation motor during braking to rotate a generator.

A hybrid structure in a construction machine such as a power shovel uses, for example, an excess output of an engine to rotate a generator for generation of electric power which is then accumulated in a battery. Then, the power of the battery is used to drive an electric motor in order to actuate an actuator. Also, discharge energy from the actuator is used to rotate the generator for generation of electric power which is similarly then accumulated in the battery. Then, the power of the battery is used to drive the electric motor for actuation of the actuator.

[Patent Literature 1] JP-A 2000-136806

[Patent Literature 2] JP-A 2002-275945

All energy produced by a rotation motor during braking is inertial energy. Disadvantageously, recovery of the inertial energy without runaway of the rotation motor is attended with difficulties. This is because, due to high inertial energy of the rotation motor, inadequate control of recovery of inertial energy leads to runaway likely occurring in the rotation motor, resulting in a high risk. On the other hand, if great weight is given to prevention of runaway of the rotation motor, it gives rise to another disadvantage of insufficient energy recovery.

Another disadvantage is a large energy loss occurring during a long process in which the excess output of the engine and the discharge energy of the actuator which is operated by fluid pressure are regenerated for use to operate the actuator.

Yet another disadvantage is that, since the actuator is operated by the electric motor, if a failure occurs in, for example, an electric system, the entire controller becomes disabled.

SUMMARY OF THE INVENTION

It is a first object of the present invention to provide a controller of a hybrid construction machine which effectively uses energy of a rotation motor as an assist force for an electric motor and as necessary to effectively use the same as energy to allow the electric motor to exercise its power generating function.

It is a second object of the present invention to provide a controller of a hybrid construction machine which is capable of efficiently recovering energy produced by a rotation motor under braking while preventing the rotation motor from running out of control in an energy recovery process.

A first invention provides an improved controller of a hybrid construction machine comprising a variable displacement type of a main pump, a circuit system connected to the main pump and including a plurality of operated valves for controlling a plurality of actuators including a rotation motor, and a neutral-condition detecting unit that detects whether or not all the operated valves provided in the circuit system are in a neutral position.

The controller comprises a variable displacement type of a hydraulic motor, a tilt angle of which is controlled by a tilt-angle control unit, a generator linked to the hydraulic motor, a hydraulic-motor system passage connected to a pair of passages connected to the rotation motor, a brake-pressure-detection pressure sensor that is provided in the hydraulic-motor system passage and detects a brake pressure of the rotation motor, a pressure relief valve provided in the hydraulic-motor system passage, a passage resistance control unit that performs control for reducing a passage resistance caused by the pressure relief valve, and a control unit connected to the tilt-angle control unit, the neutral-condition detecting unit, the brake-pressure-detection pressure sensor and the passage resistance control unit.

In turn, the control unit comprises a function of operating the passage-resistance control unit to reduce the passage resistance caused by the pressure relief valve when the control unit determines based on a detection signal received from the neutral-condition detecting unit that all the operated valves in the circuit system are in the neutral position and a pressure signal from the brake-pressure-detection processor sensor is indicative of a pressure reaching a preset pressure, a function of causing the tilt-angle control unit to control the tilt angle of the hydraulic motor, and a function of relatively controlling both the passage resistance maintained by controlling the passage resistance control unit and the tilt angle of the hydraulic motor to maintain a brake pressure of the rotation motor.

A second invention comprises: a variable displacement type of a main pump; a regulator for controlling a tilt angle of the main pump; a plurality of operated valves connected to the main pump; a rotation-motor operated valve connected to the main pump; a rotation motor connected through a pair of passages to the rotation-motor operated valve; a brake valve provided between the passages for the rotation motor; a variable displacement type of a sub pump connected to a discharge side of the main pump and having a tilt angle controlled by a tilt-angle control unit; a variable displacement type of a hydraulic motor having a tilt angle controlled by a tilt-angle control unit; an electric motor also serving as a generator and integrally rotating the sub pump and the hydraulic motor; a leading passage into which the pair of the passages for the rotation motor are merged; a passage connecting the leading passage to the hydraulic motor; a check valve provided in a stage of merging the passages for the rotation motor with the leading passage and permitting only passage of flows from the passages for the rotation motor to the leading passage; a solenoid directional control valve for opening/closing the leading passage; a pressure sensor provided between the solenoid directional control valve and the check valves; a pressure relief valve provided in the leading passage between the solenoid directional control valve and the hydraulic motor; and a control unit receiving a pressure signal from the pressure sensor and exercising a control function.

Further, the control unit controls the regulator of the main pump, the tilt-angle control unit of the sub pump, the tilt-angle control unit of the hydraulic motor and the electric motor on the basis of operational signals of the rotation motor and the other actuators. The control unit controls opening/closing of the solenoid directional control valve in accordance with a signal received from the pressure sensor, and opens the solenoid on/off valve to direct pressure fluid in the passages for the rotation motor from the leading passage through the pressure relief valve to the hydraulic motor, and uses a drive force of the hydraulic motor to assist output of the electric motor, when receiving a pressure signal indicative of a pressure lower than but close to a turning pressure of rotation motor from the pressure sensor.

In a third invention, the neutral-condition detecting unit comprises a pilot pressure generating mechanism that is provided in a neutral flow passage in the circuit system and generates a maximum pressure when all the operated valves provided in the circuit system are in the neutral position and a flow rate of a flow in the neutral flow passage is maximum, a pilot flow passage guiding the pressure of the pilot pressure generating mechanism to the regulator provided in the main pump, and a pilot-pressure-detection pressure sensor provided in the pilot flow passage and applying a detection signal to the control unit. Further, the control unit comprises a function of determining, based on the detection signal received from the pilot-pressure-detection pressure sensor, that all the operated valves provided in the circuit system are in the neutral position.

A fourth to a sixth invention comprises an electric motor also serving as a generator, rotating coaxially with the hydraulic motor, and maintaining a free rotation state or outputting power in response to a control signal from the control unit, a variable displacement type of a sub pump rotating coaxially with the hydraulic motor, a tilt angel control unit controlling a tilt angle of the sub pump in response to a signal from the control unit, and a merging passage for directing discharge fluid of the sub pump to a discharge side of the main pump. Further, the control unit comprises a function of operating the tilt-angle control unit to change the tilt angle of the sub pump when the control unit determines based on a detection signal received from the neutral-condition detecting unit that all the operated valves in the circuit system are in the neutral position.

In a seventh to a tenth invention, the passage resistance control unit includes a proportional solenoid throttling valve provided in parallel to the pressure relief valve, and a degree of opening of the proportional solenoid throttling valve is controlled by a control signal of the control unit.

In an eleventh to a fourteenth invention, the passage resistance control unit includes the pressure relief valve as an essential element. The pressure relief valve includes a main pilot pressure chamber for guiding a pressure upstream of the pressure relief valve, and a sub pilot pressure chamber for guiding a pilot pressure controlled by the control unit which are provided at one end of the pressure relief valve, and also includes a spring provided at the other end facing an acting force of a pilot pressure in both the pilot pressure chambers.

In a fifteenth to an eighteenth invention, the passage resistance control unit includes a pressure relief valve and a solenoid on/off valve that opens/closes in response to a control signal from the control unit. The pressure relief valve includes a main pilot pressure chamber provided at one end of the pressure relief valve for guiding a pressure upstream of the pressure relief valve, and also includes a spring and a sub pilot pressure chamber for guiding a pressure upstream of the Pressure relief valve by way of a throttle which are provided at the other end of the pressure relief valve facing an acting force of a pilot pressure in the main pilot pressure chamber. The solenoid on/off valve blocks a communication between the sub pilot pressure chamber and a tank when it is in a closed position, and allows a communication between the sub pilot pressure chamber and the tank when it is in an open position.

According to the first, third to eighteenth inventions, when the rotation motor performs a braking operation while all the operated valves in the circuit system are held in the neutral position, inertial energy resulting from the braking can be converted into electric energy. In addition, by controlling the tilt angle of the hydraulic motor, the rotational load of the hydraulic motor can be controlled and also the passage resistance caused by the pressure relief valve can be controlled through the passage resistance control unit.

As a result, while the passage resistance in the pressure relief valve and the rotational load of the hydraulic motor are controlled, energy resulting from the braking of the rotation motor can be recovered. Accordingly, because it is possible to not only prevent runaway of the rotation motor, but also to efficiently recover energy during braking, the inconsistent objects can be simultaneously attained.

Since the passage resistance caused by the pressure relief valve can be reduced through the passage resistance control unit when a pressure signal of the pressure sensor for detecting a brake pressure is indicative of a pressure reaching a pre-set pressure, the energy efficiency is enhanced by a ratio corresponding to a reduction in passage resistance.

According to the second, fifth inventions, since the assist motor is driven by the use of fluid energy of the rotation motor and in turn the drive force of the assist motor is used to assist the electric motor which is the drive source of the sub pump, the fluid energy of the rotation motor can be efficiently used.

Also, since the pressure relief valve is disposed between the solenoid directional control valve and the assist motor, even if a fluid leak or the like occurs between the solenoid directional control valve and the assist motor, runaway of the rotation motor can be prevented.

DETAILED DESCRIPTION OF THE INVENTION

FIG. 1 illustrates a controller of a power shovel according to an embodiment of the present invention, which includes a variable displacement type of first and second main pump MP1, MP2. The first main pump MP 1 is connected to a first circuit system, while the second main pump MP 2 is connected to a second circuit system.

To the first circuit system are connected, in order of upstream toward downstream, a rotation-motor operated valve 1 for controlling a rotation motor RM, an arm-in-first-gear operated valve 2 for controlling an arm cylinder (not shown), a boom-in-second-gear operated valve 3 for controlling a boom cylinder BC, an auxiliary operated valve 4 for controlling an auxiliary attachment (not shown), and a first travel-motor operated valve 5 for controlling a first travel motor for left traveling (not shown).

Each of the operated valves 1 to 5 is connected to the first main pump MP1 via a neutral flow passage 6 and a parallel passage 7.

A pilot pressure generating mechanism 8 is disposed on the neutral flow passage 6 downstream from the first-travel-motor operated valve 5. The pilot pressure generating mechanism 8 generates a higher pilot pressure with a higher rate of flow passing through the mechanism 8, and a lower pilot pressure with a lower rate of flow.

When all the operated valves 1 to 5 are in a neutral position or around a neutral position, the neutral flow passage 6 guides all or part of the fluid discharged from the first main pump MP1 to a tank T. At this stage, the rate of flow passing through the pilot-pressure generating mechanism 8 is increased, so that a high pilot pressure is generated as described above.

On the other hand, when switching the operated valves 1 to 5 in a full stroke position, the neutral flow passage 6 is closed to block the flow of fluid. In this case, accordingly, the rate of flow passing through the pilot-pressure generating mechanism 8 is almost zero, which means that a pilot pressure of zero is kept.

However, depending on manipulated variables for the operated valves 1 to 5, a portion of the pump discharge flow is guided to an actuator and another portion is guided from the neutral flow passage 6 to the tank. As a result, the pilot pressure generating mechanism 8 generates a pilot pressure in accordance with the rate of flow passing through the neutral flow passage 6. In other words, the pilot pressure generating mechanism 8 generates a pilot pressure in accordance with a manipulated variable for the operated valve 1 to 5.

A pilot flow passage 9 is connected to the pilot-pressure generating mechanism 8, and also connected to a regulator 10 for controlling the tilt angle of the first main pump MP1. The regulator 10 controls the discharge rate of the first main pump MP1 in inverse proportion to the pilot pressure. Accordingly, when the operated valves 1 to 5 are fully stroked and the flow rate in the neutral flow passage 6 changes to zero, in other words, when the pilot pressure generated by the pilot-pressure generating mechanism 8 reaches zero, the discharge rate of the first main pump MP1 is maintained at maximum.

A first pressure sensor 11 for detecting a pilot pressure is connected to the pilot flow passage 9 configured as described above, and detects a pressure signal which is then applied to a control unit C. Since the pilot pressure in the pilot flow passage 9 varies with manipulated variable of the operated valve, a pressure signal detected by the first pressure sensor 11 is proportional to a flow rate required in the first circuit system.

When all the operated valves 1 to 5 are in neutral positions as described above, the pilot pressure generating mechanism 8 generates a maximum pilot pressure, and also this maximum pilot pressure is detected by the first pressure sensor 11. Accordingly, the pilot pressure generating mechanism 8 and the first pressure sensor 11 comprise a neutral-condition detecting unit according to the present invention.

A sensor may be provided in operating means which includes a control lever of operating each of the operated valves 1 to 5, so that a condition in which the control lever of each operated valve is held in the neutral position may be detected through this sensor. In this case, the sensor comprises a neutral-condition detecting unit according to the present invention.

In turn, to the second circuit system are connected, in order of upstream toward downstream, a second-travel-motor operated valve 12 for controlling a second travel motor for right traveling (not shown), a bucket operated valve 13 for controlling a bucket cylinder (not shown), a boom-in-first-gear operated valve 14 for controlling the boom cylinder BC, and an arm-in-second-gear operated valve 15 for controlling the arm cylinder (not shown).

Each of the operated valves 12 to 15 is connected to the second main pump MP2 through the neutral flow passage 16. The bucket operated valve 13 and the boom-in-first-gear operated valve 14 are connected to the second main pump MP2 through a parallel passage 17.

A pilot-pressure generating mechanism 18 is provided on the neutral flow passage 16 downstream from the arm-in-second-gear operated valve 15. The pilot-pressure generating mechanism 18 is exactly identical in function with the pilot-pressure generating mechanism 8 described earlier.

A pilot flow passage 19 is connected to the pilot-pressure generating mechanism 18, and also connected to a regulator 20 for controlling the tilt angle of the second main pump MP2. The regulator 20 controls the discharge rate of the second main pump MP2 in inverse proportion to the pilot pressure. Accordingly, when the operated valves 12 to 15 are fully stroked and the flow rate in the neutral flow passage 16 changes to zero, in other words, when the pilot pressure generated by the pilot-pressure generating mechanism 18 reaches zero, a maximum discharge rate of the second main pump MP2 is maintained.

A second pressure sensor 21 for detecting a pilot pressure is connected to the pilot flow passage 19 configured as described above, and detects a pressure signal which is then applied to the control unit C. Since the pilot pressure in the pilot flow passage 19 varies with manipulated variable of the operated valve, a pressure signal detected by the second pressure sensor 21 is proportional to a flow rate required in the second circuit system.

When all the operated valves 12 to 15 are in neutral positions, the pilot pressure generating mechanism 18 generates a maximum pilot pressure, and also this maximum pilot pressure is detected by the second pressure sensor 21. Accordingly, the pilot pressure generating mechanism 18 and the second pressure sensor 21 comprise a neutral-condition detecting unit according to the present invention.

A sensor may be provided in operating means which includes a control lever for operating each of the operated valves 12 to 15, so that a condition in which the control lever of each operated valve is held in the neutral position may be detected through this sensor. In this case, the sensor comprises a neutral-condition detecting unit according to the present invention.

The first, second main pumps MP1, MP2 arranged as described above rotate coaxially by a drive force of one engine E. The engine E is equipped with a generator 22, such that the generator 22 is rotated by an excess output of the engine E for electric generation. The electric power generated by the generator 22 passes through a battery charger 23 to charge the battery 24.

The battery charger 23 is adapted to charge the battery 24 even when it is connected to a usual household power source 25. That is, the battery charger 23 is configured to be connectable to an independent power source other than the controller.

An actuator port of the rotation-motor operated valve 1 connected to the first circuit system is connected to passages 26, 27 which communicate with the rotation motor RM. Brake valves 28, 29 are respectively connected to the passages 26, 27. When the rotation motor operated valve 1 is held in its neutral position as shown in FIG. 1, the actuator port is closed, keeping the rotation motor RM in a stop state.

The rotation-motor operated valve 1 is switched from this position to, for example, a right position in FIG. 1, whereupon one passage 26 of the passages 26, 27 is connected to the first main pump MP1, while the other passage 27 is connected to the tank. As a result, pressure fluid is supplied through the passage 26 to rotate the rotation motor RM, while the return fluid flows from the rotation motor RM through the passage 27 back to the tank.

On the other hand, when the rotation-motor operated valve 1 is switched to a left position, the pump discharge fluid flows into the passage 27, while the passage 26 is connected to the tank, so that the rotation motor RM rotates in the opposite direction.

In this manner, during the operation of the rotation motor RM, the brake valve 28 or 29 functions as a relief valve. Then, when the pressure in the passage 26, 27 exceeds a set pressure, the brake valve 28, 29 is opened to introduce the fluid from the high pressure side to the low pressure side. When the rotation-motor operated valve 1 is moved back to the neutral position while the rotation motor RM is rotating, the actuator port of the operated valve 1 is closed. Even when the actuator port of the operated valve 1 is closed in this manner, the rotation motor RM continues to rotate by its inertial energy. By rotating by its inertial energy, the rotation motor RM acts as a pump. At this stage, the passage 26, 27, the rotation motor RM and the brake valve 28 or 29 form a closed circuit. The brake valve 28 or 29 converts the inertial energy to thermal energy.

On the other hand, when the boom-in-first-gear operated valve 14 is switched from the neutral position to a right position in FIG. 1, the pressure fluid flowing from the second main pump MP2 is supplied through a passage 30 to a piston chamber 31 of the boom cylinder BC, and the return fluid flows from a rod chamber 32 of the boom cylinder BC through a passage 33 back to the tank, resulting in extension of the boom cylinder BC.

In contrary, upon switching of the boom-in-first-gear operated valve 14 to a left position shown in FIG. 1, pressure fluid flowing from the second main pump MP2 is supplied through the passage 33 to the rod chamber 32 of the boom cylinder BC, while the return fluid flows from the piston chamber 31 through the passage 30 back to the tank, resulting in contraction of the boom cylinder BC. Note that the boom-in-second-gear operated valve 3 is switched in conjunction with the boom-in-first-gear operated valve 14.

A proportional solenoid valve 34, the degree of opening of which is controlled by the control unit C, is provided on the passage 30 connected between the piston chamber 31 of the boom cylinder BC and the boom-in-first-gear operated valve 14 as described above. Note that the proportional solenoid valve 34 is held in the full open position when it is in its normal state.

Next, a variable displacement-type sub-pump SP for assisting in the output of the first, second main pump MP1, MP2 will be described.

The variable displacement-type sub-pump SP rotates by a drive force of an electric motor MG also serving as a generator, and a variable displacement-type hydraulic motor HM also rotates coaxially by the drive force of the electric motor MG. The electric motor MG is connected to an inverter I. The inverter I is connected to the control unit C. Thus, the control unit C can control a rotational speed and the like of the electric motor MG.

Tilt angles of the sub pump SP and the hydraulic motor HM are controlled by tilt-angle control units 35, 36 which are controlled by output signals of the control unit C.

The sub-pump SP is connected to a discharge passage 37. The discharge passage 37 is divided into two passages, a first merging passage 38 that merges with the discharge side of the first main pump MP1 and a second merging passage 39 that merges with the discharge side of the second main pump MP2. The first, second merging passages 38, 39 are respectively provided with first, second proportional solenoid throttling valves 40, 41 the degrees of openings of which are controlled by signals output from the control unit C.

Note that reference numerals 42, 43 in FIG. 1 denote check valves located in the first, second merging passages 38, 39, which permit the fluid to flow from the sub pump SP to the first, second main pumps MP1, MP2 only.

On the other hand, the hydraulic motor HM is connected to a connection passage 44. The connection passage 44 is connected through a leading passage 45 and check valves 46, 47 to the passages 26, 27 which are connected to the rotation motor RM. In addition, a solenoid directional control valve 48, the opening/closing of which is controlled by the control unit C, is provided in the leading passage 45. A pressure sensor 49 is disposed between the solenoid directional control valve 48 and the check valves 46, 47 for detecting a turning pressure of the rotation motor RM in the turning operation or a brake pressure of it in the braking operation. A pressure signal of the pressure sensor 49 is applied to the control unit C.

A combination of the connection passage 44 and the leading passage 45 provides a hydraulic-motor system passage according to the present invention.

A pressure relief valve 50 is provided in the leading passage 45 downstream from the solenoid directional control valve 48 in relation to the flow from the rotation motor RM to the connection passage 44. The pressure relief valve 50 maintains the pressure in the passages 26, 27 at a level to prevent so called runaway of the rotation motor RM in the event of a failure occurring in a system including the connection passage 44, for example, in the solenoid directional control valve 48 or the like.

A proportional solenoid throttling valve 51 is arranged in parallel to the pressure relief valve 50. The degree of opening of the proportional solenoid throttling valve 51 is controlled in response to a control signal from the control unit C.

The higher the degree of opening of the proportional solenoid throttling valve 51, the smaller the passage resistance to the fluid flowing from the leading passage 45 into the connection passage 44 becomes. The proportional solenoid throttling valve 51 designed in this manner comprises a passage-resistance controlling unit according to the present invention.

Another leading passage 52 is arranged between the boom cylinder BC and the proportional solenoid valve 34 to communicate with the connection passage 44. A solenoid on/off valve 53 is placed in the leading passage 52 and controlled by the control unit C.

The tilt angle of the sub pump SP is changed to zero, while the tilt angle of the hydraulic motor HM is kept. In this stage, the fluid is directed into the hydraulic motor HM. Thus, the hydraulic motor HM rotates, which rotates the electric motor MG, causing the electric motor MG to exercise its function as a generator. In this case, accordingly, the electric motor MG provides the generator according to the present invention.

The hydraulic motor HM exerts an assist force on the electric motor MG, and, together with the sub pump SP, exercises the booster function. Next, the booster function will be described.

The output of the hydraulic motor HM depends on a product of a displacement volume $Q_1$ per rotation and the pressure $P_1$ at this time. Likewise, the output of the sub pump SP depends on a product of a displacement volume $Q_2$ per rotation and the discharge pressure $P_2$. In the embodiment, since the hydraulic motor HM and the sub pump SP rotate coaxially, equation $Q_1 \times P_1 = Q_2 \times P_2$ must be established. For this purpose, for example, assuming that the displacement volume $Q_1$ of the hydraulic motor HM is three times as high as the displacement volume $Q_2$ of the sub pump SP, that is, $Q_1 = 3Q_2$, the equation $Q_1 \times P_1 = Q_2 \times P_2$ results in $3Q_2 \times P_1 = Q_2 \times P_2$. Dividing both sides of this equation by $Q_2$ gives $3P_1 = P_2$.

Accordingly, if the tilt angle of the sub pump SP is changed to control the displacement volume $Q_2$, a predetermined discharge pressure of the sub pump SP can be maintained using the output of the hydraulic motor HM. In other words, the fluid pressure from the rotation motor RM can be built up and then discharged from the sub pump SP.

Next, operation in the embodiment will be described.

For example, when all the operated valves 1 to 5, 12 to 15 are held in a neutral position, the total discharge fluid from the first, second main pump MP1, MP2 is directed into the tank via the neutral flow passage 6, 16 and the pilot-pressure generating mechanism 8, 18. At this time, therefore, the pilot-pressure generating mechanism 8, 18 generate a maximum pilot pressure, and the generated pilot pressure is directed into the regulator 10, 20 via the pilot flow passage 9, 19. Then, the regulator 10, 20 receiving the high pilot pressure maintains the discharge rate of the first, second main pump MP1, MP2 at a stand-by flow rate.

At this time, the first, second pressure sensor 11, 21 for detecting a pilot pressure detects a pilot pressure in the pilot flow passage 9, 19, and applies the pressure signal to the control unit C. The control unit C determines, based on the signal of the first, second pressure sensor 11, 21, that the assist of the sub pump SP is not necessary under present conditions, and decreases the output of the sub pump SP to zero. There are two ways for decreasing the output of the sub pump SP to zero, that is, either the rotation of the electric motor MG is maintained and the tilt angle of the sub pump SP is reduced to zero, or the rotation of the electric motor MG is stopped. Which way to choose may depend on characteristics of the construction machine, working characteristics at the time, and/or the like.

When any of the operated valves 1 to 5, 12 to 15 held in the neutral position is switched, a portion of the discharge flow of the first, second main pump MP1, MP2 is supplied to the actuator in accordance with the amount of switching of the operated valve, and the remainder is guided to the tank via the neutral flow passage 6, 16 and the pilot-pressure generating mechanism 8, 18.

Thus, the pilot-pressure generating mechanism 8, 18 generates a pilot pressure in accordance with the rate of flow passing through the neutral flow passage 6, 16. The rate of flow passing through the neutral flow passage 6, 16 is low, and correspondingly the pilot pressure at this time is lower than that when all the operated valves 1 to 5, 12 to 15 are held in the neutral position. The discharge rate of the first, second main pump MP1, MP2 is increased by an amount corresponding to the pilot pressure drop.

When the operated valve 1 to 5, 12 to 15 is fully stroked, the neutral flow passage 6 is blocked at the fully stroked operated valve. Hence, the fluid does not flow into the pilot-pressure generating mechanism 8, 18. As a result, the pilot pressure generated by the pilot-pressure generating mechanism 8 becomes zero, and the discharge rate of the first, second main pump MP1, MP2 is maintained at maximum.

When the discharge rate of the first, second main pump MP1, MP2 is ensured as described above, and also, the control unit C receives a pressure signal from the first, second pressure sensor 11, 21 as described earlier and determines that the discharge rate of the first, second main pump MP1, MP2 is ensured, the control unit C performs control processing for ensuring the assist flow rate of the sub pump SP. Note that, in the embodiment, an assist flow rate of the sub pump SP is pre-set, but the control unit C is configured to determine whether control of a tilt angle of the sub pump SP or control of a rotational speed of the electric motor MG is efficient for ensuring the set flow rate, and then to perform the most efficient control processing.

In particular, as described later, control software for the control unit C is designed to allow the control unit C to make a determination to cause the sub pump SP to most efficiently exert its assist force while using torque of the hydraulic motor HM when the hydraulic motor HM is rotated by return fluid from the boom cylinder BC, working fluid of the rotation motor RM or the like.

As described above, since the rates of flow passing through the neutral flow passages 6, 16 are different in accordance with manipulated variables of the operated valves, it is possible to determine a flow rate required by a relevant circuit system, based on a pressure generated by the pilot-pressure generating mechanism 8, 18. For this reason, the control unit C determines a flow rate required by a relevant circuit system in accordance with a pressure detected by the first, second pressure sensor 11, 21, controls the degree of opening of the first, second proportional solenoid throttling valve 40, 41 in accordance with the required flow rate, and proportionally divide the discharge flow of the sub pump SP for delivery to the both circuit systems.

Next, the case of operating the rotation-motor operated valve 1 for the turning operation of the motor RM will be described.

First, when the operated valve 1 is held in the neutral position shown in FIG. 1, the actuator port is closed, keeping the rotation motor RM in a stop state.

Upon switching of the rotation-motor operated valve 1 from the above state to, for example, a right position in FIG. 1, the passage 26 is connected to the first main pump MP1, while the other passage 27 communicates with the tank. As a result, the pressure fluid is supplied through the passage 26 to the rotation motor RM, so that the rotation motor RM rotates. The return fluid from the rotation motor RM is returned to the tank through the passage 27.

When the rotation-motor operated valve 1 is switched to a left position in the opposite direction from the above-described position, this time, the fluid discharged from the pump flows through the passage 27, and the passage 26 communicates with the tank, thus rotating the rotation motor RM in the reverse direction.

When the rotation motor RM is driven as described above, the brake valve 28 or 29 exerts a function as a relief valve. Then, when the pressure in the passage 26, 27 exceeds a set pressure, the brake valve 28, 29 opens to direct the fluid from the high pressure side to the low pressure side. When the rotation-motor operated valve 1 is moved back to the neutral position while the rotation motor RM is rotating, the actuator port of the operated valve 1 is closed. Even when the actuator port of the operated valve 1 is closed in this manner, the rotation motor RM continues to rotate by its inertial energy. By rotating by its inertial energy, the rotation motor RM acts as a pump. At this stage, the passage 26, 27, the rotation motor RM and the brake valve 28 or 29 form a closed circuit. The brake valve 28 or 29 converts the inertial energy to thermal energy, resulting in application of a brake to the rotation motor RM.

Now, for example, if the rotation-motor operated valve 1 is returned to the neutral position from the state of operating the rotation motor RM alone to conduct the turning operation, a brake is applied to the rotation motor RM and all the operated valves 1 to 5, 12 to 15 in both the circuit systems are held in the neutral position. From pressure signals sent from the first, second pressure sensors 11, 21 and a pressure signal sent from the pressure sensor 49, the control unit C can be aware of such conditions in which all the operated valves 1 to 5, 12 to 15 are held in the neutral position and also the rotation motor RM exerts a braking force. At this time, the control unit C detects a pressure immediately before the brake valve 28, 29 opens, from a detection signal sent from the pressure sensor 49. A reference value of a pressure immediately before the brake valve 28, 29 opens as described above is pre-stored in the control unit C.

When the pressure indicated by the signal from the pressure sensor 49 reaches a pressure close to an opening pressure of the brake valve 28, 29 and is within the range that the braking force of the rotation motor RM is not affected, the control unit C switches the solenoid directional control valve 48 from the closed position to the open position, maintains the electric motor MG in the free rotation state, and controls the degree of opening of the proportional solenoid throttle valve 51 to move it in the opening direction. At the same time, the control unit C changes the tilt angle of the sub pump SP to zero and controls the tilt angle of the hydraulic motor HM.

Through the control as described above, the return fluid of the rotation motor RM under braking is supplied to the hydraulic motor HM through the leading passage 45 and the connection passage 44. As a result, the hydraulic motor HM can be rotated and the torque of the hydraulic motor HM can be used to rotate the electric motor MG as a generator.

Note that reference numerals 54, 55 in FIG. 1 denote check valves permitting only flows from the tank to the passages 26, 27. When the rate of flow supplied to the hydraulic motor HM is insufficient when a brake is applied to the rotation motor RM, the fluid is sucked up from the tank through the check valves 54, 55.

The hydraulic motor HM can be rotated by the use of the return fluid in the braking operation of the rotation motor RM as described above. However, during such a rotation of the hydraulic motor HM, the pressure in the leading passage 45 and the connection passage 44 must be maintained at a pressure at which the rotation motor RM can exert a braking force. For this purpose, the control unit C controls the degree of opening of the proportional solenoid throttling valve 51 and the tilt angle of the hydraulic motor HM such that a pressure signal of the pressure sensor 49 can be maintained in a pressure required by the rotation motor RM for exerting a braking force.

Specifically, when a small degree of opening of the proportional solenoid throttling valve 51 is set, the passage resistance can be increased, thus correspondingly increasing the pressure in the leading passage 45. When the tilt angle of the hydraulic motor HM is controlled to be small, the load pressure of the hydraulic motor RM can be increased, resulting in a maintained high pressure in the leading passage 45. In this regard, control software for the control unit C is configured to achieve most efficient control by relatively controlling the degree of opening of the proportional solenoid throttling valve 51 and the tilt angle of the hydraulic motor HM.

In principle, the most efficient method is to decrease the pressure loss in the proportional solenoid throttling valve 51 to allow all the energy produced in the braking operation of the rotation motor RM to be used for the hydraulic motor HM. However, when, due to high inertial energy, the energy cannot be absorbed by a rotation load alone of the hydraulic motor HM, the degree of opening of the proportional solenoid throttling valve 51 may be set smaller.

At all events, while monitoring pressure signals from the pressure sensor 49 for detecting a brake pressure, the control unit C controls the degree of opening of the proportional solenoid throttling valve 51 and the tilt angle of the hydraulic motor HM to rotate the hydraulic motor HM, thus allowing the electric motor MG to function as a generator.

Furthermore, when the electric motor MG is used as a generator by the use of return fluid of the rotation motor RM under braking as described above, the fluid can be caused to flow through the proportional solenoid throttling valve 51 arranged in parallel to the pressure relief valve 50, resulting in little pressure loss in the pressure relief valve 50.

A description has been given of energy recovery during braking of the rotation motor RM when all the operated valves 1 to 5, 12 to 15 are held in the neutral position. It should be understood that the energy of the rotation motor RM can be recovered on the same principles as in the above-described case even when all the operated valves 1 to 5, 12 to 15 are not held in the neutral position.

Specifically, the rotation-motor operated valve 1 is switched to a right or left position, for example, to a right position in FIG. 1, in order to drive the rotation motor RM connected to the first circuit system. Thereupon, the passage 26 communicates with the first main pump MP1, while the passage 27 communicates with the tank, thus rotating the rotation motor RM. The turning pressure at this time is maintained at a set pressure of the brake valve 28. On the other hand, if the operated valve 1 is switched to a leftward position in FIG. 1, the passage 27 communicates with the first main pump MP1, while the passage 26 communicates with the tank, thus rotating the rotation motor RM. In this case, the turning pressure at this time is also maintained at a set pressure of the brake valve 29.

If the rotation-motor operated valve 1 is switched to the neutral position during the turning operation of the rotation motor RM, a closed circuit is formed between the passages 26, 27 as described earlier, and also the brake valve 28 or 29 maintains a brake pressure in the closed circuit to convert the inertial energy to thermal energy.

Then, the pressure sensor 49 detects the turning pressure of the brake pressure and applies the pressure signal to the control unit C. The control unit C switches the solenoid directional control valve 48 from the closed position to the open position when the detected pressure is slightly lower than a set pressure of the brake valve 28, 29 and is within the range that the turning or braking operation of the rotation motor RM is not affected. By switching the solenoid directional control valve 48 to the open position in this manner, the pressure fluid guided into the rotation motor RM flows into the leading passage 45 and then through the proportional solenoid throttling valve 51 and the connection passage 44 into the hydraulic motor HM.

At this time, the control unit C controls the degree of opening of the proportional solenoid throttling valve 51 and the tilt angle of the hydraulic motor HM in accordance with the pressure signal receiving from the pressure sensor 49 as in the above-described case.

In this manner, the hydraulic motor HM produces torque. Then, the torque acts on the electric motor MG rotating coaxially with the hydraulic motor HM, in which the torque of the hydraulic motor HM acts as an assist force on the electric motor MG. Accordingly, the amount of power consumed by the electric motor MG can be reduced by an amount corresponding to the torque of the hydraulic motor HM.

Alternatively, the torque of the hydraulic motor HM can be used to assist torque of the sub pump SP. In this case, a combination of the hydraulic motor HM and the sub pump SP exercises the pressure conversion function.

Specifically, the fluid pressure flowing into the connection passage 44 is often lower than the pump discharge pressure. For the purpose of causing the sub pump SP to maintain a high discharge pressure using this low pressure, the hydraulic motor HM and the sub pump SP are configured to exercise the booster function as described earlier.

Thus, the fluid pressure from the rotation motor RM can be built up and then discharged from the sub pump SP.

Note that, when the pressure in a system including the passage 44, 45 is reduced to be lower than the turning pressure or the brake pressure due to any cause, the control unit C closes the solenoid directional control valve 48 in accordance with the pressure signal from the pressure sensor 49, in order to prevent the rotation motor RM from being affected.

When fluid leakage occurs in the connection passage 44, the control unit C closes the proportional solenoid throttling valve 51 and operates the pressure relief valve 50 in order to prevent a reduction in pressure in the passage 26, 27 more than necessary, thus preventing runaway of the rotation motor RM.

Next, a description will be given of control for the boom cylinder BC by switching the boom-in-first-gear operated valve 14 and the boom-in-second-gear operated valve 3 in the first circuit system working in conjunction with the operated valve 14.

The boom-in-first-gear operated valve 14 and the operated valve 3 working in conjunction with it are switched in order to actuate the boom cylinder BC, whereupon a sensor (not shown), which detects the switching circumstances, detects a manipulated direction and a manipulated variable of the operated valve 14, and sends the manipulation signal to the control unit C.

The control unit C determines in response to the manipulation signal of the sensor whether the operator is about to move up or down the boom cylinder BC. If the control unit C receives a signal indicative of moving-up of the boom cylinder BC, the control unit C maintains the proportional solenoid valve 34 in a normal state. In other words, the proportional solenoid valve 34 is kept in its full-open position.

On the other hand, if the control unit C receives a signal indicative of moving-down of the boom cylinder BC, the control unit C calculates a moving-down speed of the boom cylinder BC desired by the operator in accordance with the manipulated variable of the operated valve 14, and closes the proportional solenoid valve 34 and switches the solenoid on/off valve 53 to the open position.

By closing the proportional solenoid valve 34 and switching the solenoid on/off valve 53 to the open position as described above, the total amount of return fluid from the boom cylinder BC is supplied to the hydraulic motor HM. However, if the flow rate consumed by the hydraulic motor HM is lower than the flow rate required for maintaining the moving-down speed desired by the operator, the boom cylinder BC cannot maintains the moving-down speed desired by the operator. In this event, the control unit C controls, based on the manipulated variable of the operated valve 14, the tilt angle of the hydraulic motor HM, the rotational speed of the electric motor MG and the like, the degree of opening of the proportional solenoid valve 34 to direct a greater flow rate than that consumed by the hydraulic motor HM back to the tank, thus maintaining the moving-down speed of the boom cylinder BC desired by the operator.

On the other hand, upon the fluid flowing into the hydraulic motor HM, the hydraulic motor HM rotates and this torque acts on the electric motor MG which rotates coaxially. In turn, the torque of the hydraulic motor HM acts as an assist force intended to the electric motor MG. Thus, the power consumption can be reduced by an amount of power corresponding to the torque of the hydraulic motor HM.

In this regard, the sub pump SP can be rotated using only the torque of the hydraulic motor HM without a power being supplied to the electric motor MG. In this case, the hydraulic motor HM and the sub pump SP exercise the pressure conversion function as in the aforementioned case.

Next, the case of simultaneously carrying out the turning operation of the rotation motor RM and the moving-down operation of the boom cylinder BC will be described.

When the boom cylinder BC is moved down while the rotation motor RM is operated for the turning operation, the fluid from the rotation motor RM and the return fluid from the boom cylinder BC join in the connection passage 44 and flow into the hydraulic motor HM.

In this regard, if the pressure in the connection passage 44 rises, the pressure in the leading passage 45 also rises with this pressure rise. Even if the pressure in the leading passage 45 exceeds the turning pressure or the brake pressure of the rotation motor RM, the pressure rise has no influence on the rotation motor RM because the check valves 46, 47 are provided.

If the pressure in the leading passage 45 reduces lower than the turning pressure or the brake pressure as described earlier, the control unit C closes the solenoid directional control valve 48 on the basis of a pressure signal from the pressure sensor 49.

Accordingly, for simultaneously carrying out the turning operation of the rotation motor RM and the moving-down operation of the boom cylinder BC as described above, the tilt angle of the hydraulic motor HM may be determined with reference to the required moving-down speed of the boom cylinder BC irrespective of the turning pressure or the brake pressure.

At all events, the output of the hydraulic motor HM can be used to assist the output of the sub pump SP, and also the amount of fluid discharged from the sub pump SP can be proportionally divided at the first, second proportional solenoid throttling valves 40, 41 for delivery to the first, second circuit systems.

On the other hand, for use of the hydraulic motor HM as a drive source and the electric motor MG as a generator, the tilt angle of the sub pump SP is changed to zero such that the sub pump SP is put under approximately no-load conditions, and the hydraulic motor HM is maintained to produce an output required for rotating the electric motor MG. By doing so, the output of the hydraulic motor HM can be used to allow the electric motor MG to exercise the generator function.

In the embodiment, the output of the engine E can be used to allow the generator 22 to generate electric power or the hydraulic motor HM can be used to allow the electric motor MG to generate electric power. Then, the electric power thus generated is accumulated in the battery 24. In the embodiment, since the household power source 25 may be used to accumulate electric power in the battery 24, the electric power of the electric motor MG can be utilized for various components.

A second embodiment illustrated in FIG. 2 differs in the passage resistance control unit from the first embodiment, but the other structure is the same as that in the first embodiment. The passage resistance control unit according to the second embodiment includes a pressure relief valve 50 as an essential element. At one end of the pressure relief valve 50, the valve 50 is provided with a main pilot pressure chamber 56 for guiding a pressure upstream of the pressure relief valve, and a sub pilot pressure chamber 57 for guiding a pilot pressure controlled by the control unit C. In addition, at the other end opposite to the one end, the pressure relief valve 50 is provided with a spring 58, such that a spring force of the spring 58 counters an acting force produced by the pilot pressure in the main pilot pressure chamber 56 and the sub pilot pressure chamber 57.

In the pressure relief valve 50 designed as described above, the sub pilot pressure chamber 57 is acted upon by a pilot pressure which is controlled by the control unit C. As a result, the pressure relief valve 50 can be opened even when a pressure in the leading passage 45 is equal to or lower than a set pressure of the pressure relief valve 50. That is, because a pressure in the sub pilot pressure chamber 57 is added to a pressure in the main pilot pressure chamber 56, the pressure relief valve 50 is opened, even if the pressure in the main pilot pressure chamber 56 is equal to or lower than the set pressure. Further, if an abnormal condition occurs in the pressure in the leading passage 45, the control unit C reduces the pressure acting on the sub pilot pressure chamber 57 or changes it to zero such that the pressure relief valve 50 is controlled by the pressure in the leading passage 45 and the spring force of the spring 58.

A third embodiment illustrated in FIG. 3 differs in the passage resistance control unit from the first embodiment, but the other structure is the same as that in the first embodiment. The passage resistance control unit according to the third embodiment includes a pressure relief valve 50 as an essential element. At one end of the pressure relief valve 50, the valve 50 is provided with a main pilot pressure chamber 59 for guiding a pressure upstream of the pressure relief valve 50. At the other end opposite to the main pilot pressure chamber 59, the pressure relief valve 50 is provided with a sub pilot pressure chamber 60 and a spring 61. Further, a pressure upstream of the pressure relief valve 50 is guided into the sub pilot pressure chamber 60 through an orifice 62. Also, a solenoid on/off valve 63 is provided for closing the orifice 62 on the downstream side or connecting it to the tank.

The solenoid on/off valve 63 is provided with a spring 63*a* at one end of the valve 63, and with a solenoid 63*b* at the other end against a spring force of the spring 63*a*. The solenoid 63*b* is connected to the control unit C. The solenoid on/off valve 63 is usually held in the closed position shown in FIG. 3 by the spring force of the spring 63*a*, but is switched to the open position when the solenoid 63*b* is energized by a control signal from the control unit C.

Accordingly, when solenoid on/off valve 63 is in the closed position shown in FIG. 3, the total force of an acting force of the sub pilot pressure chamber 60 and a spring force of the spring 61 counters an acting force of the main pilot pressure chamber 59, resulting in an increased set pressure of the pressure relief valve 50.

On the other hand, when the solenoid on/off valve 63 opens, the spring force of the spring 61 alone counters the acting force of the main pilot pressure chamber 59, resulting in a reduced set pressure of the pressure relief valve 50. Therefore, the passage resistance at this time decreases.

A fourth embodiment illustrated in FIG. 4 employs a proportional solenoid valve 64 including a combination of the proportional solenoid valve 34 and the solenoid on/off valve 53 which are shown in FIG. 1. The proportional solenoid valve 64 is usually kept in the open position shown in FIG. 4, and upon reception of a signal from the control unit C, the proportional solenoid valve 64 is switched to a right position in FIG. 4. In the proportional solenoid valve 64 switched to the right position in FIG. 4, a throttle 64*a* is located in the communication process between the boom cylinder BC and the tank T, and a check valve 64*b* is located between the boom cylinder BC and the hydraulic motor HM. The degree of opening of the throttle 64*a* is controlled in accordance with the amount of switching of the proportional solenoid valve 64.

In each of the aforementioned embodiments, the check valves 42, 43 are provided and the solenoid directional control valve 48 and the solenoid on/off valve 53 or the proportional solenoid valve 64 are provided. Accordingly, for example, when a failure occurs in the system including the sub pump SP and the hydraulic motor HM, the system including the first, second main pumps MP1, MP2 can be detached from the system including the sub pump SP and the assist motor AM. In particular, when the solenoid directional control valve 48, the proportional solenoid valve 64 and the solenoid on/off valve 50 are under normal conditions, each of them is kept in the normal position which is the close position by a spring force of a spring as illustrated in the drawings, and also the proportional solenoid valve 34 and the proportional solenoid valve 64 are kept in the normal position which is the full open position. For this reason, even if a failure occurs in the electric system, the system including the first, second main pumps MP1, MP2 can be detached from the system including the sub pump SP and the hydraulic motor HM as described above.

INDUSTRIAL APPLICABILITY

The present invention is best suited to application to construction machines such as a power shovel and the like.

REFERENCE SIGNS LIST

Figure 1:
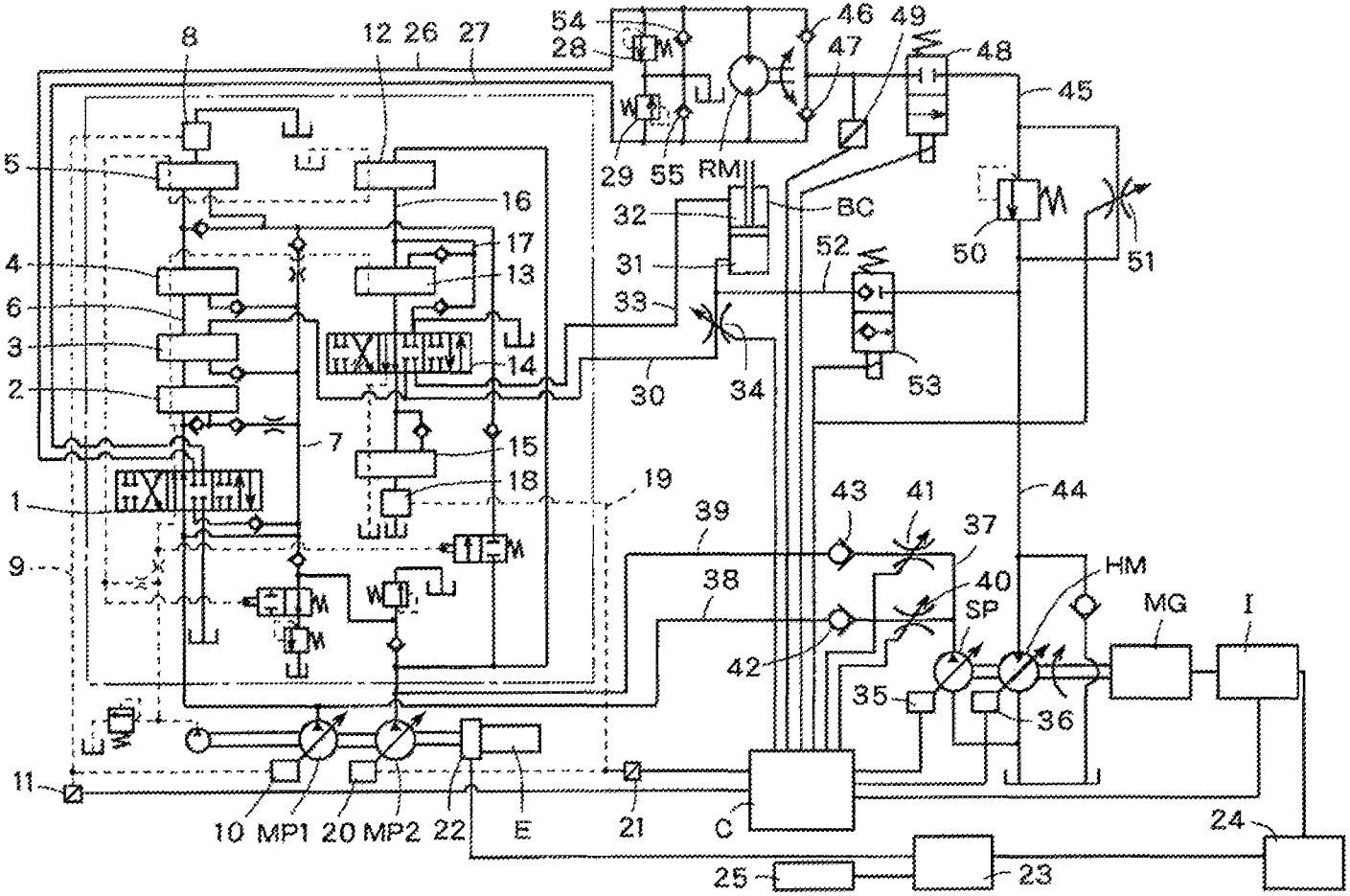
FIG. 1 is a circuit diagram according to a first embodiment.
Figure 2:
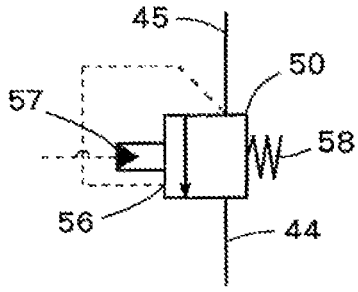
FIG. 2 is a circuit diagram according to a second embodiment.
Figure 3:
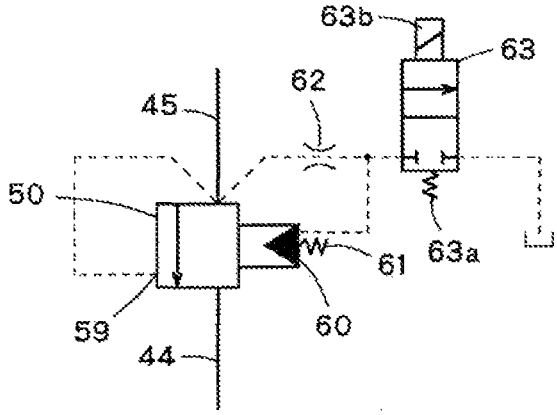
FIG. 3 is a circuit diagram according to a third embodiment.
Figure 4:
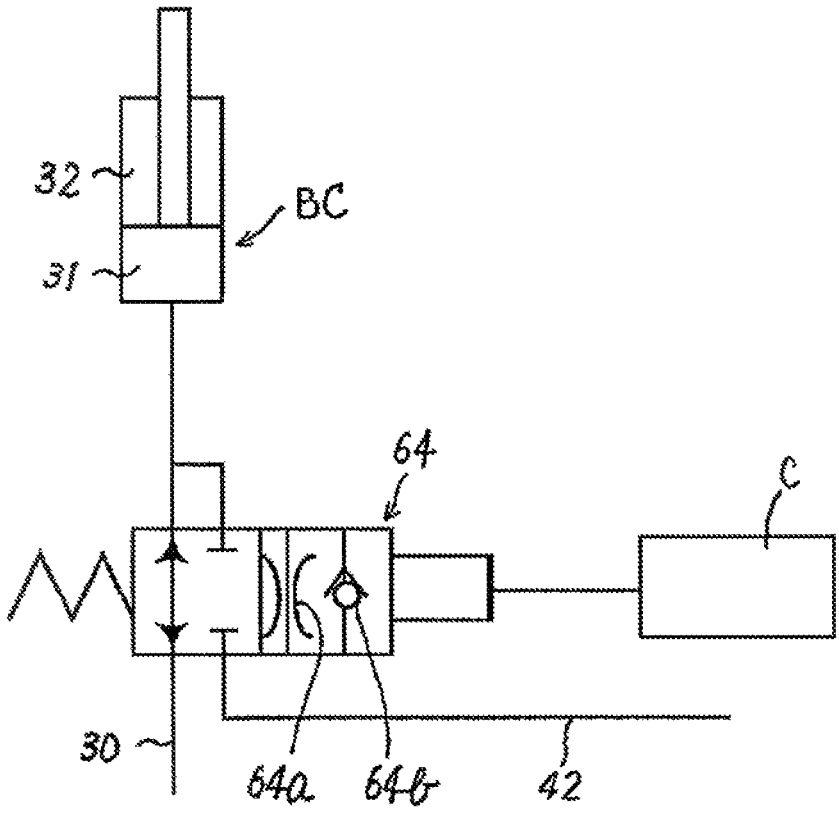
FIG. 4 is a circuit diagram according to a fourth embodiment.

MP1 First main pump
MP2 Second main pump
RM Rotation motor
1 Rotation-motor operated valve
2 Arm-in-first-gear operated valve
3 Boom-in-second-gear operated valve
4 Auxiliary operated valve
5 First-travel-motor operated valve
6 Neutral flow passage
8 Pilot pressure generation mechanism
9 Pilot flow passage
10 Regulator
11 First pressure sensor for detecting pilot pressure
C Control unit
12 Second-travel-motor operated valve
13 Bucket operated valve
14 Boom-in-first-gear operated valve
15 Arm-in-second-gear operated valve
16 Neutral flow passage
17 Parallel passage
18 Pilot pressure generation mechanism
19 Pilot flow passage
20 Regulator
SP Sub pump
35, 36 tilt-angle control unit
HM Hydraulic motor
MG Electric motor serving as generator
42, 43 Check valve
44 connection passage
45 Leading passage
48 solenoid directional control valve
50 Pressure relief valve
51 Proportional solenoid throttling valve
56 Mine pilot pressure chamber
57 Sub pilot pressure chamber
58 Spring
59 Main pilot pressure chamber
60 Sub pilot pressure chamber
61 Spring
63 Solenoid on/off valve

What is claimed is:

1. A hybrid construction machine, comprising:
a main pump;
a first hydraulic motor;

a first hydraulic passage that drives the first hydraulic motor using a discharge pressure of the main pump;

a second hydraulic motor that varies a motor capacity according to a tilt angle thereof;

a power generator connected to the second hydraulic motor;

a hydraulic control circuit that controls a flow in the first hydraulic passage, the hydraulic control circuit comprising a plurality of valves all of which are switched to a neutral position upon input of a braking command of the first hydraulic motor;

a brake circuit that is activated when all of the plurality of valves are switched to the neutral position and causes the first hydraulic motor in rotation to act as a hydraulic pump;

a second hydraulic passage that supplies a discharge pressure of the first hydraulic motor acting as a hydraulic pump to the second hydraulic motor;

a safety valve that regulates a flow resistance in the second hydraulic passage system;

a pressure sensor that detects the discharge pressure of the first hydraulic motor acting as a hydraulic pump;

a neutral position detecting sensor detecting that all of the plurality of valves are in the neutral position; and a programmable control unit programmed to:

control the safety valve to decrease the flow resistance in the second hydraulic passage when and a detected pressure of the pressure sensor has reached a predetermined pressure in a state where all of the plurality of valves are in the neutral position;

control the tilt angle of the second hydraulic motor to compensate for a pressure drop in the second hydraulic passage when the safety valve has decreased the flow resistance in the second hydraulic passage.

2. The hybrid construction machine according to claim 1, wherein the neutral position detecting sensor comprises a pilot pressure generating mechanism that is provided in a neutral flow passage in the hydraulic control circuit and generates a maximum pressure when all the valves provided in the hydraulic control circuit are in the neutral position and a flow rate of a flow in the neutral flow passage is maximum, a pilot flow passage guiding the pressure of the pilot pressure generating mechanism to the regulator provided in the main pump, and a pilot-pressure-detection pressure sensor provided in the pilot flow passage and applying a detection signal to the control unit, and the control unit comprises a function of determining, based on the detection signal received from the pilot-pressure-detection pressure sensor, that all the operated valves provided in the hydraulic control circuit are in the neutral position.

3. The hybrid construction machine according to claim 2, comprising an electric motor also serving as a generator, rotating coaxially with the hydraulic motor, and maintaining a free rotation state or outputting power in response to a control signal from the control unit, a variable displacement type of a sub pump rotating coaxially with the hydraulic motor, a tilt angel control unit controlling a tilt angle of the sub pump in response to a signal from the control unit, and a merging passage for directing discharge fluid of the sub pump to a discharge side of the main pump, wherein the control unit comprises a function of operating the tilt-angle control unit to change the tilt angle of the sub pump when the control unit determines based on a detection signal received from the neutral position detecting sensor that all the valves in the hydraulic control circuit are in the neutral position.

4. The hybrid construction machine according to claim 2, wherein the safety valve includes a proportional solenoid throttling valve provided in parallel to a pressure relief valve, and a degree of opening of the proportional solenoid throttling valve is controlled by a control signal of the control unit.

5. The hybrid construction machine according to claim 2, wherein the safety valve includes a pressure relief valve as an essential element, and the pressure relief valve includes a main pilot pressure chamber for guiding a pressure upstream of the pressure relief valve, and a sub pilot pressure chamber for guiding a pilot pressure controlled by the control unit which are provided at one end of the pressure relief valve, and also includes a spring provided at the other end facing an acting force of a pilot pressure in both the pilot pressure chambers.

6. The hybrid construction machine according to claim 2, wherein the safety valve includes a pressure relief valve and a solenoid on/off valve that opens/closes in response to a control signal from the control unit, the pressure relief valve includes a main pilot pressure chamber provided at one end of the pressure relief valve for guiding a pressure upstream of the pressure relief valve, and also includes a spring and a sub pilot pressure chamber for guiding a pressure upstream of the pressure relief valve by way of a throttle which are provided at the other end of the pressure relief valve facing an acting force of a pilot pressure in the main pilot pressure chamber, the solenoid on/off valve blocks a communication between the sub pilot pressure chamber and a tank when it is in a closed position, and allows a communication between the sub pilot pressure chamber and the tank when it is in an open position.

7. The hybrid construction machine according to claim 3, wherein the safety valve includes a proportional solenoid throttling valve provided in parallel to a pressure relief valve, and a degree of opening of the proportional solenoid throttling valve is controlled by a control signal of the control unit.

8. The controller of a hybrid construction machine according to claim 3, wherein the safety valve includes a pressure relief valve as an essential element, and the pressure relief valve includes a main pilot pressure chamber for guiding a pressure upstream of the pressure relief valve, and a sub pilot pressure chamber for guiding a pilot pressure controlled by the control unit which are provided at one end of the pressure relief valve, and also includes a spring provided at the other end facing an acting force of a pilot pressure in both the pilot pressure chambers.

9. The hybrid construction machine according to claim 3, wherein the safety valve includes a pressure relief valve and a solenoid on/off valve that opens/closes in response to a control signal from the control unit, the pressure relief valve includes a main pilot pressure chamber provided at one end of the pressure relief valve for guiding a pressure upstream of the pressure relief valve, and also includes a spring and a sub pilot pressure chamber for guiding a pressure upstream of the pressure relief valve by way of a throttle which are provided at the other end of the pressure relief valve facing an acting force of a pilot pressure in the main pilot pressure chamber, the solenoid on/off valve blocks a communication between the sub pilot pressure chamber and a tank when it is in a closed position, and allows a communication between the sub pilot pressure chamber and the tank when it is in an open position.

10. The hybrid construction machine according to claim 1, comprising:

an electric motor also serving as a generator, rotating coaxially with the hydraulic motor, and maintaining a free rotation state or outputting power in response to a control signal from the control unit, a variable displacement type of a sub pump rotating coaxially with the hydraulic motor, a tilt angel control unit controlling a tilt angle of the sub pump in response to a signal from the control unit, and a merging passage for directing discharge fluid of the sub pump to a discharge side of the main pump, wherein the control unit comprises a function of operating the tilt-angle control unit to change the tilt angle of the sub pump when the control unit determines based on a detection signal received from the neutral position detecting sensor that all the valves in the hydraulic control circuit are in the neutral position.

11. The hybrid construction machine according to claim 10, wherein the safety valve includes a proportional solenoid throttling valve provided in parallel to a pressure relief valve, and a degree of opening of the proportional solenoid throttling valve is controlled by a control signal of the control unit.

12. The hybrid construction machine according to claim 10, wherein the safety valve includes a pressure relief valve as an essential element, and the pressure relief valve includes a main pilot pressure chamber for guiding a pressure upstream of the pressure relief valve, and a sub pilot pressure chamber for guiding a pilot pressure controlled by the control unit which are provided at one end of the pressure relief valve, and also includes a spring provided at the other end facing an acting force of a pilot pressure in both the pilot pressure chambers.

13. The controller of a hybrid construction machine according to claim 10, wherein the safety valve includes a pressure relief valve and a solenoid on/off valve that opens/closes in response to a control signal from the control unit, the pressure relief valve includes a main pilot pressure chamber provided at one end of the pressure relief valve for guiding a pressure upstream of the pressure relief valve, and also includes a spring and a sub pilot pressure chamber for guiding a pressure upstream of the pressure relief valve by way of a throttle which are provided at the other end of the pressure relief valve facing an acting force of a pilot pressure in the main pilot pressure chamber, the solenoid on/off valve blocks a communication between the sub pilot pressure chamber and a tank when it is in a closed position, and allows a communication between the sub pilot pressure chamber and the tank when it is in an open position.

14. The hybrid construction machine according to claim 1, wherein the safety valve includes a proportional solenoid throttling valve provided in parallel to a pressure relief valve, and a degree of opening of the proportional solenoid throttling valve is controlled by a control signal of the control unit.

15. The hybrid construction machine according to claim 1, wherein the safety valve includes a pressure relief valve as an essential element, and the pressure relief valve includes a main pilot pressure chamber for guiding a pressure upstream of the pressure relief valve, and a sub pilot pressure chamber for guiding a pilot pressure controlled by the control unit which are provided at one end of the pressure relief valve, and also includes a spring provided at the other end facing an acting force of a pilot pressure in both the pilot pressure chambers.

16. The hybrid construction machine according to claim 1, wherein the safety valve includes a pressure relief valve and a solenoid on/off valve that opens/closes in response to a control signal from the control unit, the pressure relief valve includes a main pilot pressure chamber provided at one end of the pressure relief valve for guiding a pressure upstream of the pressure relief valve, and also includes a spring and a sub pilot pressure chamber for guiding a pressure upstream of the pressure relief valve by way of a throttle which are provided at the other end of the pressure relief valve facing an acting force of a pilot pressure in the main pilot pressure chamber, the solenoid on/off valve blocks a communication between the sub pilot pressure chamber and a tank when it is in a closed position, and allows a communication between the sub pilot pressure chamber and the tank when it is in an open position.

17. A hybrid construction machine, comprising:

a main pump;

a first hydraulic motor;

a first hydraulic passage that drives the first hydraulic motor using a discharge pressure of the main pump;

a sub pump that supplies a hydraulic pressure to the first hydraulic passage;

a second hydraulic motor that varies a motor capacity according to a tilt angle thereof;

an electric motor/generator that rotates synchronous with the second hydraulic motor and the sub pump;

a second hydraulic passage that supplies a hydraulic fluid discharged from the first hydraulic motor to the second hydraulic motor;

an electro-magnetic valve that closes the second hydraulic passage;

a pressure sensor that detects a pressure in the second hydraulic passage between the first hydraulic motor and the electro-magnetic valve; and a programmable control unit programmed to open the electro-magnetic valve when a pressure detected by the pressure sensor reaches a predetermined pressure in a state where the electric motor/generator is acting as an electric motor.

18. The hybrid construction machine according to claim 17, comprising:

an electric motor also serving as a generator, rotating coaxially with the hydraulic motor, and maintaining a free rotation state or outputting power in response to a control signal from the control unit, a variable displacement type of a sub pump rotating coaxially with the hydraulic motor, a tilt angel control unit controlling a tilt angle of the sub pump in response to a signal from the control unit, and a merging passage for directing discharge fluid of the sub pump to a discharge side of the main pump, wherein the control unit comprises a function of operating the tilt-angle control unit to change the tilt angle of the sub pump when the control unit determines based on a detection signal received from the neutral position detecting sensor that all the valves in the hydraulic control circuit are in the neutral position.

* * * * *

UNITED STATES PATENT AND TRADEMARK OFFICE

CERTIFICATE OF CORRECTION

PATENT NO. : 8,510,000 B2
APPLICATION NO. : 12/991074
DATED : August 13, 2013
INVENTOR(S) : Haruhiko Kawasaki et al.

It is certified that error appears in the above-identified patent and that said Letters Patent is hereby corrected as shown below:

On the title page in item (54), and in the Specification, Col. 1, the title, "HYBRID CONSTRUCTION MACHINE" should be changed to "CONTROLLER OF HYBRID CONSTRUCTION MACHINE".

Signed and Sealed this
Fifteenth Day of October, 2013

Teresa Stanek Rea
*Deputy Director of the United States Patent and Trademark Office*